United States Patent [19]

Herr

[11] 4,134,802

[45] Jan. 16, 1979

[54] ELECTROLYTE AND METHOD FOR ELECTRODEPOSITING BRIGHT METAL DEPOSITS

[75] Inventor: Roy W. Herr, Troy, Mich.

[73] Assignee: Oxy Metal Industries Corporation, Warren, Mich.

[21] Appl. No.: 839,081

[22] Filed: Oct. 3, 1977

[51] Int. Cl.[2] ..... C25D 3/12; C25D 3/22; C25D 3/38; C25D 3/56

[52] U.S. Cl. ..... 204/43 T; 204/45 R; 204/49; 204/52 R; 204/55 R; 204/DIG. 2

[58] Field of Search ..... 204/DIG. 2, 45 R, 43 T, 204/44, 52 R, 52 Y, 55 R, 55 Y, 49; 260/2 EN, 72 R

[56] References Cited

U.S. PATENT DOCUMENTS 4,022,676 5/1977 Popescu ..... 204/55 R

FOREIGN PATENT DOCUMENTS 819404 10/1951 Fed. Rep. of Germany ..... 260/72 R

*Primary Examiner*—G. L. Kaplan
*Attorney, Agent, or Firm*—Richard P. Mueller; Arthur E. Kluegel

[57] ABSTRACT

The present invention is directed to an aqueous bath for the electrodeposition of bright metal deposits, and is more particularly concerned with a bath composition which provides upon the basis metal an electrodeposit having improved brightness, superior adhesion to the substrate, and as well, a condition of ductility markedly better than that obtained from certain prior art baths. The electroplating bath composition of this invention includes therein a sulfamalkylated polyamine which is a reaction product containing nitrogen substituted alkyl sulfamate units represented by the general formulae:

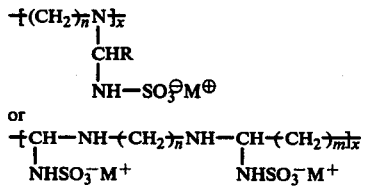

where

M = H, Li, Na, K or $NH_4$,
R = aryl, alkyl of 1 – 4 carbons,
n = 2 to 3,
m = 0 to 3, and
x = 7 to 2400.

7 Claims, No Drawings

ELECTROLYTE AND METHOD FOR ELECTRODEPOSITING BRIGHT METAL DEPOSITS

BACKGROUND OF THE INVENTION

It is known in the art to which this invention pertains to electrodeposit upon a basis metal a metallic material exemplified by zinc, copper, nickel, nickel-iron or the like utilizing in the electroplating baths a polyethylenimine having the general empirical formula $-[C_2H_5N]_x-$, and a sulfonating agent for the polyethylenimine whereby there is obtained a reaction product which contains nitrogen substituted sulfamate groups as an integral part of the polymer chain. The nitrogen substituted sulfamate unit of the reaction product is represented by the formula:

$$-[CH_2CH_2\underset{\underset{SO_3^-M^+}{|}}{N}]-$$

where, M = H, Li, Na, K or $NH_4$. The ratio of these nitrogen substituted sulfamate units to amino units, $-[CH_2CH_2N]-$, in the reaction product is determined by the molar ratio of the polymer repeat unit, $-[C_2H_5N]-$, to sulfonating agent in the reaction.

The inventive concept set forth above, which is disclosed in commonly assigned application Ser. No. 603,563 filed Aug. 11, 1975, now U.S. Pat. No. 4,101,387, has fulfilled a need long existing in the art with respect to a bath composition which simply contains polyvinyl alcohol, an aromatic aldehyde and a chelating agent. It has now been discovered by applicant that markedly improved results by way of adhesion and simplicity of manufacturing techniques can be obtained when there is incorporated in the bath composition a sulfamalkylated polyamine of the structure earlier described.

SUMMARY OF THE INVENTION

The present inventive concepts are particularly directed to a method of electrodeposition and bath composition, the bath formulation embodying a water soluble nitrogen containing condensation product of a polyamine, an aldehyde or dialdehyde and sulfamic acid. The preparation of these compounds is described in German Pat. No. 819,404 granted Oct. 31, 1951 in the name of Walter Hees, and also in a publication entitled "Sulfonation and Related Reaction" authored by Everett E. Gilbert and published in 1965 by *Interscience Publishers.*

The exact chemical composition of these condensates is not at present precisely known, however, it is stated in the prior art that the system formaldehyde-sulfamic acid can be used to introduce the sulfammethyl group $[-CH_2-NHSO_3H]$ into organic compounds in a manner analogous to the well known sulfomethylation reaction. The latter reaction generally proceeds in this manner:

$$R_1R_2NH + CH_2O + NaHSO_3 \rightarrow R_1R_2-N-CH_2-SO_3Na$$

On the other hand, in a sulfammethylation reaction the following sequence of steps is generally followed:

$$R_1R_2NH + CH_2O + NH_2SO_3H \rightarrow R_1R_2N-CH_2-NH-SO_3H$$

Based upon these assumptions, a probable structure for the condensation product of a polyethylenimine, formaldehyde, and sulfamic acid is one which contains nitrogen substituted sulfammethyl groups as an integral part of the polymer chain. This nitrogen substituted sulfammethyl unit of the condensation product is represented by the formula:

$$-(CH_2-CH_2-\underset{\underset{CH_2NHSO_3H}{|}}{N})-$$

The ratio of these nitrogen substituted sulfammethyl units to amino units, $-(CH_2CH_2NH)-$, in the condensation product is determined by the molar ratio of the polymer repeat unit $-(CH_2CH_2NH)-$, to formaldehyde and sulfamic acid in the reaction.

If a dialdehyde is condensed with a polyamine and a sulfamic acid, a condensation product with generally similar properties for use in electroplating applications is obtained. A probable structure for this condensate is depicted in the following reaction scheme:

$$NH_2-(CH_2)_n-NH_2 + OHC-(CH_2)_m-CHO + 2\,NH_2SO_3H \rightarrow -[\underset{\underset{NHSO_3H}{|}}{CH}-NH-(CH_2)_n-NH-\underset{\underset{NHSO_3H}{|}}{CH}-(CH_2)_m]_x-$$

where n = 2 m = 0 or 3.

The reaction sequence described above may also be set forth in the following terms. In the case of an aldehyde of the general formula R-CHO, reacted with a polyamine having substantially the formula $-[(CH_2)]_n NH]_x$, and sulfamic acid there is obtained a reaction product which includes nitrogen substituted alkyl sulfamate groups as an integral part of the polymer chain. The nitrogen substituted alkyl sulfamate unit of the reaction product is represented by the formula:

$$-(CH_2)_n\underset{\underset{\underset{NH-SO_3^{\ominus}M^{\oplus}}{|}}{\underset{\underset{CHR}{|}}{N}}}{}$$

where

M = H, Li, Na, K or $NH_4$,

R = aryl, alkyl of 1–4 carbons, and n = 2 to 3.

The ratio of these substituted alkyl sulfamate units to amino units $-[(CH_2)_nNH]-$, in the reaction product is determined by the molar ratio of the polymer repeat unit, $-[(CH_2)_nNH]-$, to aldehyde and sulfamic acid in the reaction.

In the case of a dialdehyde of the general formula, $OHC-(CH_2)_m$ CHO, reacted with a diamine of the general formula $H_2N-(CH_2)_n$ $NH_2$ and sulfamic acid, there is similarly obtained a reaction product containing N-substituted alkyl sulfamate units, represented by the general formula:

$$\underset{\underset{NHSO_3^-M^+}{|}}{CH}-NH-(CH_2)_n-NH-\underset{\underset{NHSO_3^-M^+}{|}}{CH}-(CH_2)_m-$$

where

M = H, Li, Na, K or $NH_4$,

R = aryl, alkyl of 1–4 carbons, n = 2 to 3 and m = 0 to 3.

DESCRIPTION OF THE PREFERRED EMBODIMENT

Applicant's invention is directed to the electrodeposition of bright zinc, copper, iron-nickel and other metallic materials utilizing in the metal finishing bath a water soluble polyelectrolyte containing nitrogen substituted alkyl sulfamate units. More particularly, the polyamine has the general empirical formula set forth above, and when reacted with an aldehyde and sulfamic acid it has the general chemical composition also noted herein. Desirably, when a polyamine such as polyethylenimine is reacted with an aldehyde and sulfamic acid, the molar ratio of the polymer repeat units, $-[(CH_2)_n NH]-$ to the aldehyde and sulfamic acid may vary from about 1.1 to 1.5.

The invention will first be described more fully in connection with generally known cyanide zinc plating baths, zincate plating baths and neutral or acidic zinc plating solutions, however, the advantageous results achieved by this invention in the form of improved brightness, ductility, ease of manufacture and adhesion will be further apparent when reference is made to nickel-iron plating baths. In the examples now to be described, the sulfamalkylated polyamine is employed in the amount of about 0.0008 to 0.5 g/l, however, generally acceptable results may be obtained when this compound is used in the range of approximately 0.0001 to 1.0 g/l.

EXAMPLE I

A cyanide zinc plating bath was formulated incorporating therein 75 g/l sodium hydroxide, 11 g/l of zinc and 16.5 g/l of sodium cyanide. A standard 267 ml Hull cell panel was plated with this solution, and the deposit obtained was typically gray, although generally uniform in appearance.

EXAMPLE II

A panel of like dimensions using the electrolyte of Example I was prepared, however, there was added 40 mg/l of sulfamalkylated polyamine based on polyethyleneimine (MW 1200). It was observed that the deposit had a very noticeble bright low current density area.

EXAMPLE III

A conventional zincate plating bath was prepared utilizing 100 g/l of sodium hydroxide and 10 g/l of zinc. Hull cell specimens plated with this solution produced relatively dark and non-adherent deposits. However, when there was added to this same zincate solution a relatively small amount of sulfamalkylated polyamine of the order of about 0.5 g/l, a fine-grain deposit was obtained having a semi-bright to bright appearance.

EXAMPLE IV

An acid zinc sulfate bath was prepared as follows:

187 g/l zinc sulfate 20 g/l boric acid 15 g/l ammonium sulfate

The pH of the solution was adjusted to 4.5. Using agitation an average cathode current density of 40 ASF a uniform dull, grainy deposit was obtained after 15 minutes of plating on a standard J shaped panel.

Following the addition of 0.25 g/l of sulfamalkylated polyethyleneimine derived from a polyamine having a molecular weight of 1200, the deposit, plated under similar conditions, provided a bright deposit in the 15–70 ASF range.

EXAMPLE V

An acid copper bath was prepared as follows:

225 g/l copper sulfate 67 g/l concentrated sulfuric acid 50 mg/l $Cl^-$ ion

Using air agitation and well known acid copper brighteners such as polyglycols of molecular weight 6000 and organic disulfides, at 40 ASF cathode current density, there was obtained a bright J shaped panel with a cloud in the low current density area and poor leveling.

Upon addition of 0.0008 g/l of sulfamalkylated polyethyleneimine derived from a polyamine having a molecular weight of 1200, the deposit plated under similar conditions produced a fully bright deposit in all current density areas and had improved leveling.

The novel concepts of this invention are also applicable to the electrodeposition of bright deposits from neutral and acidic zinc plating solutions, and particularly significant results are obtained in the electroplating bright iron-nickel alloy deposits upon both metallic and plastic substrates.

A nickel-iron deposit preferably contains from about 5 to 50% by weight iron, and as an optimum, about 15 to 35% by weight. In order to introduce iron and nickel ions into the bath, any bath soluble iron or nickel containing compound may be employed provided that the corresponding ion is not detrimental to the bath. Preferably inorganic nickel salts are employed, such as, nickel sulfate, nickel chloride, and the like as well as other nickel materials such as nickel sulfamate. When nickel sulfate salts are used, they are normally present in amounts ranging from 40 to 300 g/l (calculated as nickel sulfate $.6H_2O$); nickel chloride may also be used and is present in an amount ranging from about 80 to 250 g/l. The chloride or halide ions are employed in order to obtain satisfactory conductivity of the solution and at the same time to impart satisfactory corrosion properties to the soluble anodes.

Preferably the inorganic salts of iron are employed, such as, ferrous salts exemplified by ferrous sulfate, ferrous chloride and the like. These salts are preferably present in an amount ranging from about 3 to 60 grams per liter. Other bath soluble iron salts may be employed, as for example soluble ferrous fluoborate or sulfamate.

The iron complexing agent employed in the present invention is one that is bath soluble and contains complexing groups selected from the group consisting of carboxy and hydroxy provided that at least one of the complexing groups is a carboxy group and further that there are at least two complexing groups present. The complexing agent that may be employed is present in an amount ranging from about 10 to about 100 grams per liter. Suitable complexing agents are hydroxy substituted lower aliphatic carboxylic acids having from 2 to 8 carbon atoms, from 1 to 6 hydroxyl groups and from 1 to 3 carboxyl groups such as, ascorbic acid, isoascorbic acid, citric acid, malic acid, glutaric acid, gluconic acid, muconic, glutamic, glucoheptonate, glycollic acid, aspartic acid and the like, as well as amine containing complexing agents, such as nitrilotriacetic acid, ethylene diamine tetra-acetic acid, or the water soluble salts thereof such as ammonium and the alkali metal salts such as potassium, sodium lithium, and the like. It will also be appreciated that the iron may be introduced into the bath as a salt of the complexing agent.

By "carboxy" is meant the group -COOH. However, it is to be appreciated that in solution, the proton disassociates from the carboxy group and therefore this group is encompassed within the meaning of carboxy.

The purpose of the complexing agent is to keep the metal ions, in particular, the ferrous and ferric ions in solution. It has been found that as the pH of a normal Watts nickel plating bath increases above a pH of 3.0, ferric ions tend to precipitate as ferric hydroxide. The complexing agent prevents the precipitation from taking place and therefore makes the iron and nickel ions available for electrodeposition from the complexing agent.

While the iron is always introduced as the ferrous salt, it has been established that a portion of the iron in solution is almost always oxidized from the ferrous to ferric state. The concentration of ferric ion in solution is determined by a number of factors, and particularly by the operating pH of the solution. The type and amount of anode area in the solution will also affect the relative concentration of ferric ion. We believe this may be due to the oxidizing of ferrous to ferric ion at the anode. Generally speaking, it is found that at least 5% of the total iron in solution is present as ferric ions, and it is preferred that the ferric ion not exceed 30 to 40% of the total iron in the bath, although it has been established in work performed to date that acceptable results may be obtained when even as much as 60% of the iron in the solution is present as ferric ions. It has been observed that the relative concentration of ferric ion will be higher in an air agitated solution than one that is dependent on only cathode agitation. The exact structure which is formed by the interaction of the ferric ion with the complexing agent is not presently precisely known. The literature reports a number of possible structures under different conditions; for instance, the structure reported in water solution may be different from that determined in biological applications. We also have reason to believe that the structure in a plating solution changes during electrolysis. Regardless of the exact structure, the ferric ion is not precipitated from the solution, as the hydroxide, even at a pH of 5.

Because of the operating parameters employing the complexing agent, the pH of the bath preferably ranges from about 2.5 to about 5.5 and even more preferably about 3 to about 4.6. The temperature of the bath generally ranges from about 120° F. to about 180° F., preferably about 160° F. The average cathode current density varies from about 10 to about 70 amps per square foot and preferably about 45 amps per square foot. While the bath may be operated without agitation, various means of agitation may be employed such as mechanical agitation, air agitation, cathode rod movement and the like.

It is preferred that the complexing agent concentration be at least three times the total iron ion concentration in the bath. The complexing agent concentration ratio to total iron ion concentration may range from about 3 to 50 to 1.

The bath may also contain various buffers such as boric acid and sodium acetate and the like ranging in amounts from about 30 to 60 grams per liter, preferably 40 grams per liter. The ratio of nickel ions to iron ions generally ranges from about 5 to about 50 to 1.

It has also been found that various nickel brightening, additives may be employed to impart brightness, ductility and leveling to the iron nickel deposits. Suitable additives which may be used are the sulfo oxygen compounds such as those described as brighteners of the first class described in *Modern Electroplating*, published by John Wiley and Sons, Second Edition, Page 272.

The amount of sulfo-oxygen compounds employed in the present invention may range from about 0.5 to about 10 grams per liter. It has been found that saccharin may be used in amounts ranging from 0.5 to about 5 grams per liter and which results in a bright ductile deposit. When other sulfo-oxygen compounds are employed, such as, naphthlenetrisulfonic, sulfobenzaldehyde and dibenzenesulfonamide, good brightness is obtained; however, the ductility is not nearly as good as with saccharin. In addition to the above sulfo-oxygen compounds that may be used, others which are suitable are sodium allyl sulfonate, benzene sulfinates, vinyl sulfonate, beta-styrene sulfonate, and cyano alkane sulfonates (having from 1 to 5 carbon atoms).

The bath soluble sulfo-oxygen compounds that may be used in the present invention are those such as the unsaturated aliphatic sulfonic acids, mononuclear and binuclear aromatic sulfonic acids, mononuclear aromatic sulfinic acids, mononuclear aromatic sulfonamides and sulfonimides, and the like.

To illustrate the invention further, a number of examples will be given generally utilizing a nominal solution composition as follows:

| | | |
|---|---|---|
| $NiSO_4 \cdot 6H_2O$ | 75 | g/l |
| $NiCl_2 \cdot 6H_2O$ | 75 | g/l |
| $H_3BO_3$ | 45 | g/l |
| $FeSO_4 \cdot 7H_2O$ | 10 | g/l |
| $C_5H_6(OH)_5COONa$ | 14 | g/l |
| $C_3H_4(OH)(COONa)_3$ | 6 | g/l |
| Saccharin | 3 | g/l |
| Sodium Allyl Sulfonate | 5.4 | g/l |
| pH | 3.4 | |
| Temperature | 150° F | |
| Air Agitation | | |

EXAMPLE VI

To the nickel-iron formulation set forth immediately above, there was added a compound obtained by reacting polyamine [1200 molecular weight] with sulfamic acid and formaldehyde. This was utilized at a concentration of 8 mgs/l together with 45 mgs/l of the ethylene oxide adduct of propargyl alcohol. Excellent brightness and leveling were obtained in the nickel-iron deposit.

The sulfamalkylated polyethylenimine utilized in the electrodeposition method and bath composition of this invention may be formulated in various ways, and reference was earlier made herein to German Pat. No. 819,404 and the publication authored by Gilbert and entitled "Sulfonation and Related Reactions." In order to establish the feasibility of the reactions set forth in the noted German patent, a number of reactions were run. Basically, the first series of reactions utilized in combination with the sulfamic acid, a 37% aqueous solution of formaldehyde, and polyethylenimine of various molecular weights. Polyethylenimine having molecular weights of 3, 6, 12, 18 and 1,000 were investigated, and since the same reaction procedure was utilized with these various molecular weights, the method of preparation of sulfamalkylated polyamine will only be described in connection with polyethylenimine having a molecular weight of about 1200. Sulfamic acid [194 g 2.0 moles] was slurried with 110 ml of water. With the temperature maintained below 50° C. with an ice bath, 124 g [2.88 mole - units] of polyethyleneimine (MW 1200) and 40 ml of water was added with vigorous stirring. The mixture was heated to about 85° C. and 167 g of 37% aqueous formaldehyde was added with the temperature held at about 90° to 95° C. The mixture was then refluxed for 3 hours, and diluted to 1 liter. This gave a 35% solution.

Other methods for preparation of the general compound utilizing the bath of this invention were also investigated. One procedure involved utilizing glutaraldehyde, ethylenediamine and sulfamic acid. Sulfamic acid [194 g 2.0 moles] was slurried with 110 ml of water. To this stirred slurried there was added 75 ml [66 g, 1.1 mole] of ethylenediamine with the temperature kept below 50° C. with an ice bath. The mixture was then heated to 90° C. and 420 ml [445 g, 1.1 mole] of 25% aqueous glutaraldehyde was added over 30 minutes with the temperature at 90° to 95° C. The mixture was then refluxed for 3 hours, cooled and diluted to 1 liter, which gave a 35% solution. Generally this same reaction sequence was followed except that glyoxal was substituted for glutaraldehyde. In this formulation there was employed 160 g of 40% glyoxal solution [1.1 mole], and in other respects the other conditions used for glutaraldehyde were followed. In the second case involving glyoxal a 35% solution was obtained.

It has been noted earlier above that a bath composition in accordance with this invention utilizing sulfamalkylated polyamine not only has the advantage of providing an electrodeposit of exceptional brightness, leveling and ductility, but there are the further advantages of ease of formulation and superior adhesion to the substrate. As to ease of manufacture or formulation, the direct sulfonation of a polyamine produces a rather highly viscous reaction mixture under anhydrous conditions and normally there is utilized an anchor or helix-type stirrer. However, with sulfamalkylated polyamine the functional group is introduced by way of a condensation with a carbonyl compound, sulfamic acid and a polyamine. This general class of condensation reactions is ordinarily carried out in an aqueous solution under relatively mild conditions that is less than 100° C. For this purpose there may be employed a common tubular-type stirrer, or as it is otherwise referred to in the art, a turbine-type.

With respect to the superior adhesion properties of a nickel-iron electrodeposit produced from a bath composition containing sulfamalkylated polyamine, it has been found that under the most rigorous testing procedures at present a nickel-iron electrodeposit superior to that obtained from a bath utilizing a sulfonated polyamine is obtained. Conventional testing procedures involve first a single bend of the panel which might induce lifting of the deposit, followed by grinding down one or more edges of the panel with heat. A third test for adhesion characteristics is that you plate under a normal condition in the bath for approximately 5 minutes, turn the current off for 30 seconds while the panel is still in the bath, turn the current on for an additional 10 minutes, and then subject the plated panel to bending and grinding. In most instances, panels in which the bath contained a sulfamalkylated polyamine were superior to a bath having therein sulfonated polyamine, particularly in the test sequence during which the current is off and on during the plating operation.

Various changes and modifications in the bath and process in this invention have been disclosed herein, and these and other variations may of course be practiced without departing from the novel concepts of this invention.

What is claimed is:

1. An aqueous bath for the electrodeposition of bright zinc, copper, nickel-iron, and other metallic materials upon a substrate, which comprises a source of zinc, copper, nickel and iron ions or other metallic ions, and a sulfamalkylated polyamine for improving the brightness, ductility and leveling properties of the metallic electrodeposit.

2. A process for producing a bright metallic finish upon a substrate, comprising passing current through the bath of claim 1, and electrodepositing said finish upon a cathode surface.

3. An aqueous bath for the electrodeposition of bright zinc, copper, nickel-iron and other metallic materials upon a substrate, which comprises a source of zinc, copper, nickel and iron ions or other metallic ions, and at least 0.0001 g/l of a reaction product of a polyamine having the general empirical formula $-[C_2H_5N]_x-$, an aldehyde and sulfamic acid, said reaction product containing nitrogen substituted alkyl sulfamate groups as an integral part of the polymer chain and X = 7 to 2400.

4. An aqueous bath as defined in claim 3, in which the nitrogen substituted alkyl sulfamate of the reaction product is represented by the formula:

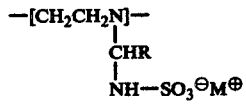

where, M = H, Li, Na, K or $NH_4$.

5. A process for producing a bright metallic finish upon a substrate, comprising passing current through the bath of claim 3, and electrodepositing said finish upon a cathode surface.

6. An aqueous bath for the electrodeposition of bright nickel-iron upon a substrate, which comprises a source of nickel and iron ions, about 10 to 100 g/l of a complexing agent, about 30 to 60 g/l of a buffering agent, approximately 0.5 to 10 g/l of a brightening agent, and a sulfamalkylated polyamine present in an amount of about 0.0001 to 1.0 g/l for improving the brightness, ductility and leveling properties of the electrodeposit.

7. A process for producing a bright metallic finish upon a substrate, comprising passing current through the bath of claim 6, and electrodepositing said finish upon a cathode surface.

* * * * *